US006189248B1

(12) United States Patent
Nagel et al.

(10) Patent No.: US 6,189,248 B1
(45) Date of Patent: Feb. 20, 2001

(54) SNAP-ON MOUNTING BRACKET FOR ELECTRONIC LABEL HOLDERS

(75) Inventors: Thomas O. Nagel, Blairstown, NJ (US); Harold B. Bond, Wilkes-Barre; Richard J. Wildrick, Hunlock Creek, both of PA (US)

(73) Assignee: Trion Industries, Inc., Wilkes-Barre, PA (US)

( * ) Notice: Under 35 U.S.C. 154(b), the term of this patent shall be extended for 0 days.

(21) Appl. No.: 09/428,217

(22) Filed: Oct. 27, 1999

Related U.S. Application Data

(63) Continuation-in-part of application No. 08/933,473, filed on Sep. 18, 1997.

(51) Int. Cl.[7] ..... G09F 3/20

(52) U.S. Cl. ..... 40/661.03; 40/658; 248/222.51; 248/345.1

(58) Field of Search ..... 40/652, 658, 661.11, 40/661.03; 248/222.51, 345.1; 211/59.1, 87.01, 90.01

(56) References Cited

U.S. PATENT DOCUMENTS

| | | | | |
|---|---|---|---|---|
| 790,098 | * | 5/1905 | Baird | 40/661.11 |
| 4,911,392 | * | 3/1990 | Fast | 40/657 |
| 5,220,739 | * | 6/1993 | Chich et al. | 40/564 |
| 5,237,767 | * | 8/1993 | Kringel et al. | 40/642 |
| 5,683,003 | * | 11/1997 | Gebka | 40/642 |

* cited by examiner

*Primary Examiner*—Cassandra H. Davis
(74) *Attorney, Agent, or Firm*—Schweitzer Cornman Gross & Bondell LLP

(57) ABSTRACT

A mounting bracket for securing an electronic label to the front of a store display shelf. The bracket is a one-piece metal sheet formed to provide a central body portion with clips for securing the electronic label. An upper support member extends rearwardly from the upper edge of the body portion and has shelf-engaging lugs adapted to be received in selected ones of regularly spaced openings in the shelf. A spring clip extends rearward from the bottom edge and resiliently and/or frictionally engages bottom contours of the shelf, to secure the bracket at the front edge of the shelf. The bracket is considerably less expensive and easier to install then conventional devices for this purpose, which typically extend the full length of a display shelf.

6 Claims, 4 Drawing Sheets

FIG. 6
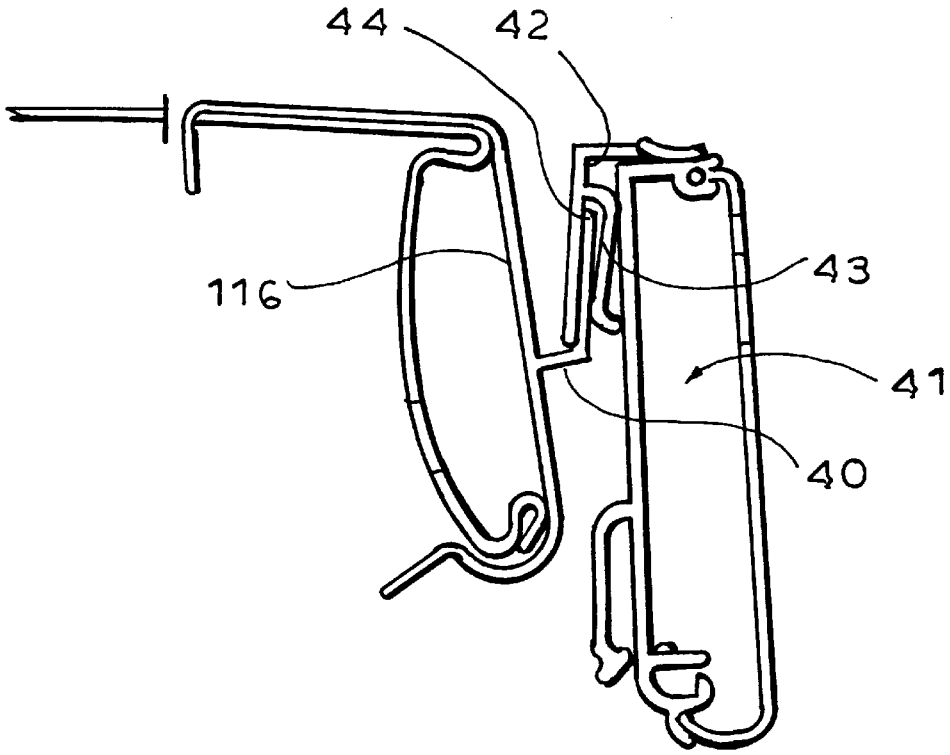
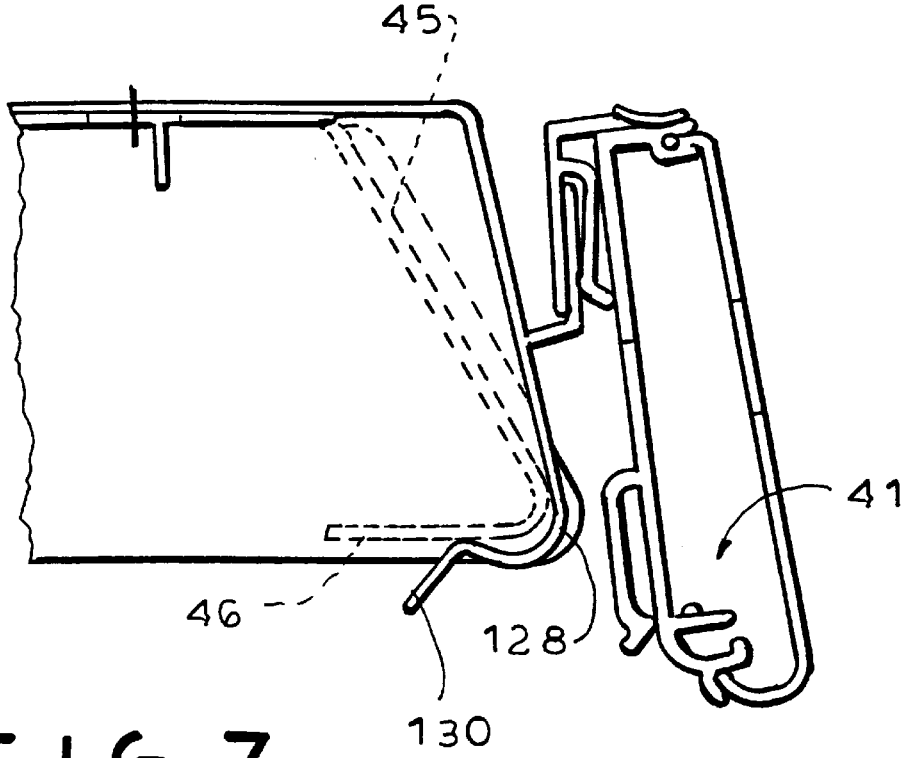
FIG. 7

SNAP-ON MOUNTING BRACKET FOR ELECTRONIC LABEL HOLDERS

RELATED APPLICATIONS

This application is a continuation-in-part of copending U.S. application Ser. No. 08/933,473, filed Sep. 18, 1997.

BACKGROUND AND SUMMARY OF THE INVENTION

Large retailers are increasingly converting to the use of electronic labels to indicate pricing and other information relating to products displayed on their shelves. Such electronic labels greatly facilitate pricing and repricing of the goods as compared to, for example, the printing and placement of new paper labels. At the same time, the electronic labels represent a relatively costly initial investment and it is thus important that they be securely mounted on the display shelves.

Some styles of display shelving are either provided with, or are initially formed with, price ticket moldings along the front edges of the shelves. These are designed principally for receiving paper or plastic labels of the conventional type. There are also some styles of display shelving, that have no provision for ticket moldings along the front edge. The present invention is directed particularly to providing a novel and advantageous form of individual mounting clip, for securing an electronic label to the front edge of a display shelf, regardless of whether the shelf is provided with a ticket molding along the front edge.

Display shelving of the type contemplated herein typically is formed of sheet metal, having a flat upper surface, a front edge structure extending downward from the upper surface, and a flange-like structure extending rearward at least a short distance from the lower edge area of the front surface structure. In some cases, the front surface structure of the shelving is configured to form a ticket molding. In other cases, it may be relatively flat. The upper surface of the shelving is formed, at least in the front area and typically throughout, with regularly spaced rows and columns of apertures. Such shelving is typically constructed in sections, referred to as gondolas, which are standardized at 48 inches in length. One prior approach to the mounting of electronic labels on shelving of the type described above involves the mounting of a special extrusion, running along the full length of the shelving and arranged to receive one or more electronic labels at desired positions associated with merchandise display. The extrusions appropriate for this purpose are somewhat costly, and require a 48 inch unit even though possibly only one or two electronic labels will be mounted.

In accordance with the present invention, a metal clip-type mounting bracket, formed of heat treated spring steel, is provided for engagement with individual electronic labels, and for the mounting of such labels individually in fixed position at the front of the display shelving. To this end, the mounting clip includes a central body portion and an upper support member extending rearwardly from the upper edge thereof and having shelf-engaging lugs arranged for snap-in engagement with a spaced pair of the apertures formed in the upper surface of the shelving. A spring clip element extends rearward from the bottom edge of the central body portion and can be displaced to allow the clip to snap over the lower edge structure of the shelving, locking the mounting bracket firmly and reliably to the front edge of the shelving, at a desired specific location. The mounting bracket can be easily removed for intentional relocation, but is very securely mounted against accidental dislodgement.

The new mounting clip of the invention is configured so that, by squeezing together on the upper support member, and the lower spring clip element, the bracket is easily attached to an electronic label. Thereafter, when the bracket is attached to a shelf, the spreading-apart action of the shelf on the same two elements serves to securely lock the electronic label onto the bracket.

The device of the invention can be economically manufactured from a unitary sheet metal stamping and is easily shaped to provide the several working components described above.

For a more complete understanding of the above and other features and advantages of the invention, reference should be made to the following detailed description of preferred embodiments of the invention and to the accompanying drawings.

DESCRIPTION OF THE DRAWINGS

FIG. 6 is a side elevational view of a modified form of the invention utilizing a different arrangement for mounting of the electronic label holder.

FIG. 7 is a side elevational view of the mounting bracket of FIG. 6, shown mounted on a display shelving structure formed with a flat, inclined front surface.

DESCRIPTION OF PREFERRED EMBODIMENTS

Figure 1:
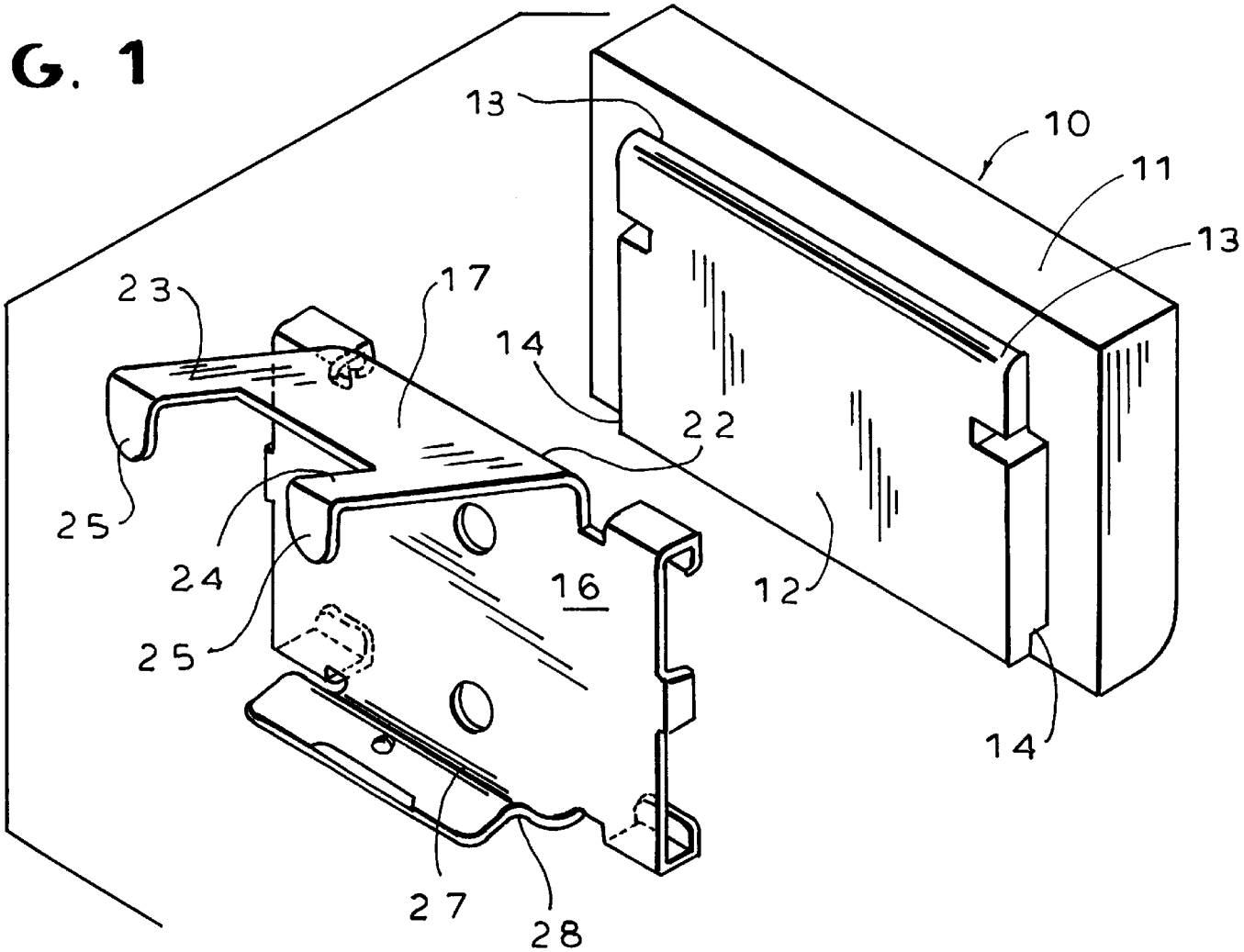
FIG. 1 is an exploded perspective view showing the mounting bracket of the invention and an electronic label which is to be mounted thereon.

Referring now to the drawing, and initially to FIGS. 1–5 thereof, the reference numeral 10 designates generally a typical electronic label which, in a representative form, may be approximately 2 inches in width, an 1¼ inch in height, and about ½ inch in overall thickness. An outer case of the label houses electronic media, including a suitable electronic display (not shown) for display of the pricing information. In the illustrated arrangement, the label housing 11 includes a rearwardly extended back portion 12, the top bottom and side edges of which are recessed with respect to the corresponding edges of the label housing 11. Additionally, the extended back portion is configured to provide clip receiving recesses 13, 14 at the upper and lower corners at both sides. The electronic label 10 and its housing configuration does not, in itself, form any part of this invention.

The new mounting bracket disclosed herein comprises a single sheet 15 of metal (advantageously 1050 high carbon steel, of a typical thickness of about 0.020 inch). The sheet 15 is stamped in the flat shape shown in FIG. 4, to provide a central body portion 16, an upper support member 17, and a lower spring clip portion 18. At the upper and lower corner areas of the central body portion 16, there are clip-forming elements 19, 20, and at the side edges of the central body portion there are tab-forming elements 21.

Pursuant to the invention, the upper support member 17 is bent rearwardly, at the upper edge 22 of the central body portion 16. Preferably, the upper support member is bent to have a slightly obtuse angle with respect to the central body portion 16, for example, an angle of 95°.

At the rearward extremity, the upper support member is formed with spaced-apart, L-shaped shelf-engaging lugs 23, 24. These are spaced apart a distance corresponding to the standard hole spacing of commercial shelving. To this end, the center-to-center spacing between the lugs 23, 24 is approximately 0.942 inch. At their outer ends, the lugs 23, 24 have downwardly projecting tabs 25 arranged to be received in shelf openings. A suitable width of the lugs 23, 24 for this purpose is approximately 0.0183 inch.

The effective length of the upper support member 17 from the upper edge 22 of the central body portion is also calculated to correspond to rows of openings in the shelving top surface (not shown). In advantageous embodiments of the invention, this distance may be 0.940 inch, to accommodate one type of standard shelving, and 0.685 inch, to accommodate another type of standardized shelving. Conveniently, the length of lug-forming elements 26 (FIG. 4) in the flat, developed form of the stamping, is such that either style of shelving may be accommodated by bending the lug-forming elements 26 at different locations.

Figure 3:
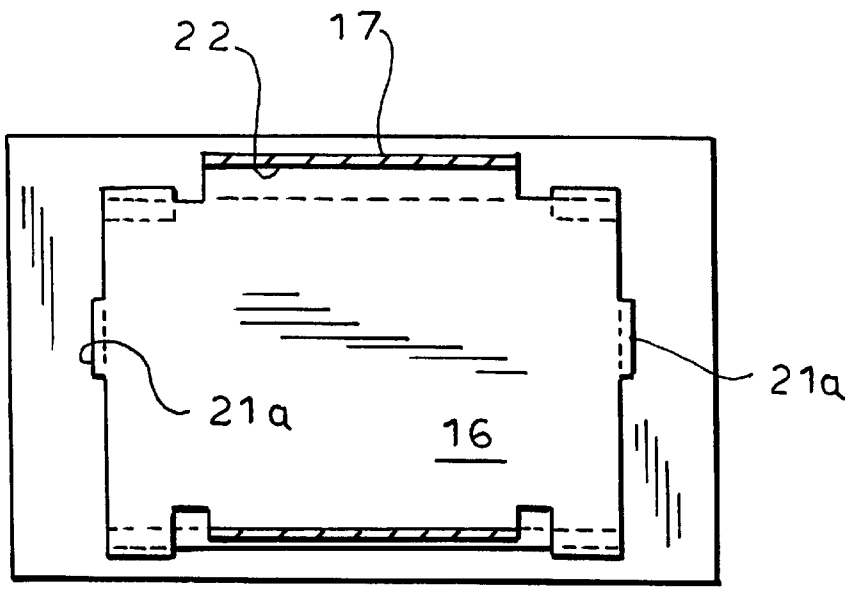
FIG. 3 is a cross sectional view as taken generally on line 3—3 of FIG. 2.
Figure 2:
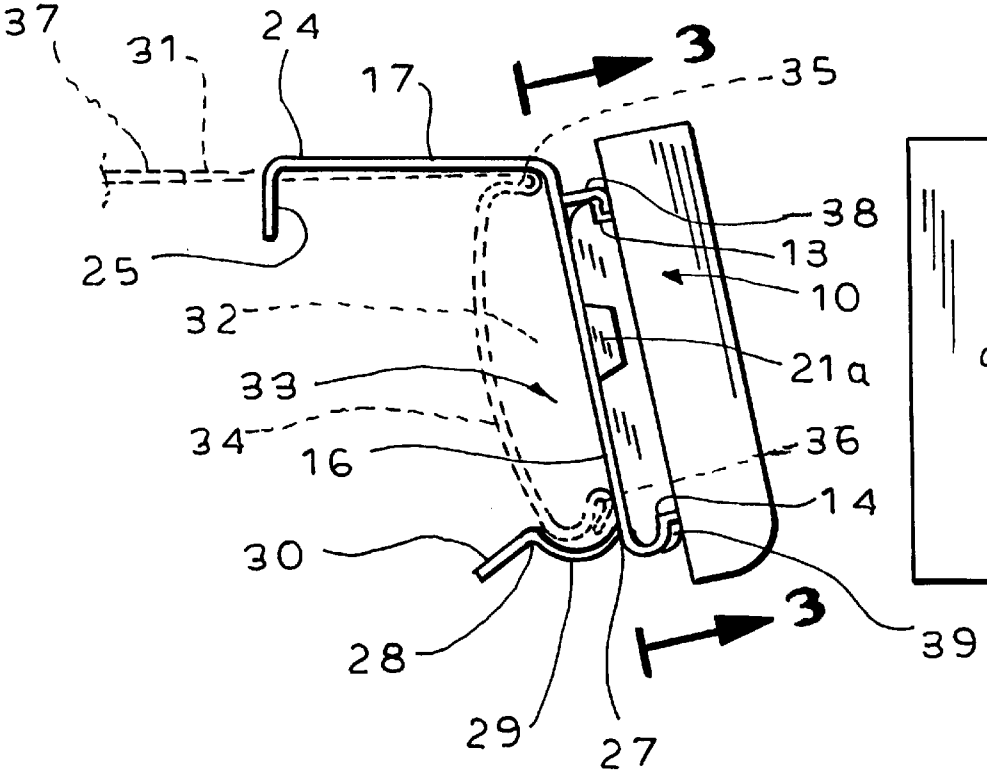
FIG. 2 is a side elevational view of the mounting bracket with an electronic label mounted therein, illustrating the manner in which the mounting bracket is secured to display shelving.
Figure 4:
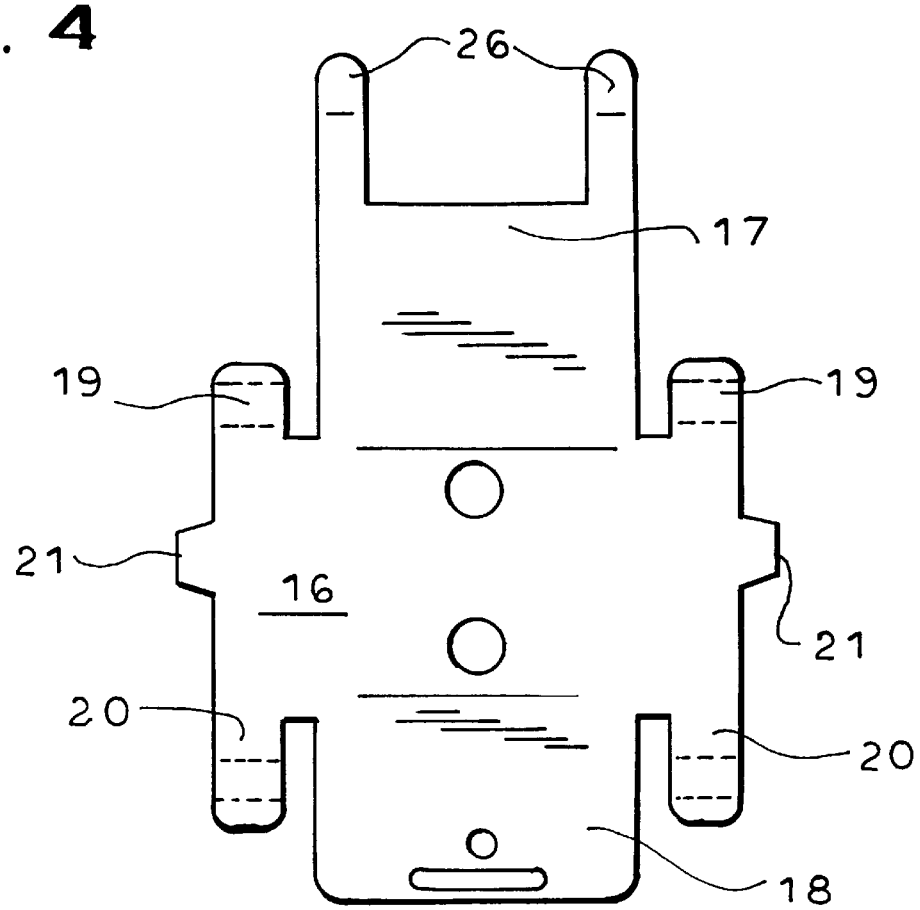
FIG. 4 is a flat, developed view of the metal stamping from which the mounting bracket is formed.
Figure 5:
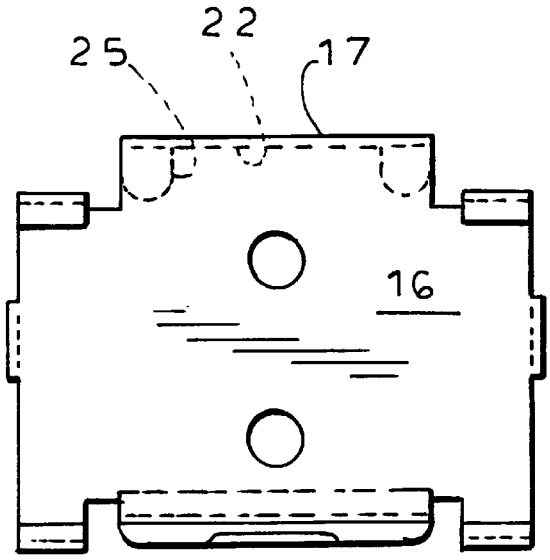
FIG. 5 is a front elevational view of the mounting bracket, shown without the electronic label holder mounted therein.

The flat metal form of FIG. 4 is bent rearwardly along the lower edge 27 of the central body portion to provide an integral spring clip member 28. As shown in FIG. 3, the spring clip element 28 preferably comprises an upwardly concave first portion 29 extending directly from the lower edge 27, and a downwardly extending guide tab portion 30. A typical installation of the mounting bracket in a standard shelving arrangement is shown in FIG. 2, which illustrates in broken lines the front edge region of a standard display shelf having a row of openings 31 near its front edge portion 32. In the illustration of FIG. 2, the front configuration of the shelving is such that the front edge defines a generally outwardly concave ticket molding 33 formed with a central portion 34 recessed somewhat rearward from upper and lower flanges 35, 36. The upper support portion of the mounting bracket is applied over the top surface 37 of the shelving, so that the spaced lugs 23, 24 are received in spaced openings 31 in the shelving. The effective length of the upper support member 17 is such that the central body portion 16 snugly engages the upper flange 35. After first engaging the upper support member 17, the lower portion of the bracket is pressed forcibly rearward, causing the spring clip element 28 to snap over the lower flange portion 36 of the shelving, as shown in FIG. 2. The guide tab 30 serves to assist in the resilient displacement of the spring clip 28 during this operation. Once installed in the manner shown in FIG. 2, the mounting bracket is tightly and reliably engaged with the shelving. Removal can be effected by engaging the guide tab 30 and pulling downward, to free the lower end of the bracket and allow it to be pivoted upward away from the lower flange 36.

An advantageous arrangement for securing of the electronic label 10 to the mounting bracket is formed by bending the clip-forming sections 19, 20 (FIG. 4), to provide upper and lower, forwardly extending L-shaped label supporting clips 38, 39. The respective upper and lower L-shaped clips are arranged to be received in the recesses 13, 14 provided at the upper and lower corners of the label back extension 12, as indicated in FIG. 2. Additionally, tab-forming elements 21 are bent forwardly, at each side edge of the central body portion, forming confining tabs 21*a* to limit lateral movement of the electronic label 10 with respect to the mounting bracket. In a typical and advantageous embodiment of the invention, the label supporting clips 38, 39 may extend forward from the central body portion 16 a distance of about 0.156 inch, with an inwardly projecting end flange of about 0.062 inch in length for reception in the label recesses 13, 14. These dimensions will of course be a function of the particular geometry of the label body itself such that, when the L-shaped clips 38, 39 are engaged in the recesses 13, 14, the label body is securely held in the mounting bracket.

To advantage, mounting and removal of the label housing from the mounting bracket can be facilitated by squeezing together the upper support member 15 and the spring clip element 28 at the respective upper and lower edges of the central body portion. This tends to distort the central body portion into somewhat of a forwardly convex configuration, which tends to slightly increase the spacing between the L-shaped clips 38, 39, thus facilitating installation and removal of the label housing. By the same principle, when the mounting bracket is installed on the front edge of a shelf, as shown in FIG. 2, the upper supporting member 17 and the spring clip 28 tend to be urged apart by the geometry of the shelf, making removal of the label housing more difficult.

In the embodiment of the invention shown in FIG. 6, the shelf-engaging features of the mounting bracket are essentially the same as in the bracket of FIGS. 1–5. The manner of mounting the label, however, differs in significant respects. In the embodiment of FIG. 6, the central body portion 116 of the mounting bracket is provided with an outwardly and upwardly projecting tongue 40. In this embodiment, a special external housing 41 is provided to receive the label itself (not shown in FIG. 6). The label housing has an integral mounting element 42, which is formed with a downwardly opening slot 43 arranged to receive an upward extension 44 of the tongue 40. The tongue 40 is designed to provide a somewhat resilient mounting for the label housing 41, to afford a high degree of protection of the label against bumping with shopping carts, etc.

In the embodiment of FIG. 7, the label housing 40 and its mounting on the bracket are essentially the same as for FIG. 6. In addition, the mounting bracket itself is the same as that shown in FIG. 6. However, the shelf structure shown in FIG. 7 differs in that it comprises a generally flat front face 45 and a generally flat, rearwardly extending bottom flange 46. When the bracket is mounted in front of the shelf, the spring clip member 128 is forced over the lower surface of the bottom flange 46, which results in substantial displacement of the spring clip member, such that it has a tight friction grip between the spring clip member and the bottom flange 46 of the shelving, to provide a secure retention of the mounting bracket. Additionally, the normal spring action of the mounting bracket will tend to urge the spring clip portion in a rearward direction, tending to retain it on the shelf in the desired manner.

The mounting clip of the invention is highly economical and easily employed. It is easily assembled to the electronic label, and then easily installed on the shelving. Each electronic label has its own inconspicuous mounting bracket, which can be located in a fixed position anywhere along the length of the shelf. The merchandiser has complete flexibility with respect to the number and location of pricing labels, without requiring a full length installation along the front of the shelving.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A snap-on mounting bracket for mounting an electronic label holder to a front portion of a store shelf, the shelf having an upper surface provided with a plurality regularly and closely spaced openings, a front surface and a bottom surface, which comprises (a) an upper support member extending generally horizontally and adapted to extend over a shelf upper surface, (b) said upper support member having front and back portions and said back portion having downwardly extending shelf-engaging lugs adapted for reception in openings of said shelf upper surface, (c) a central body portion integral with said upper support member and extending downwardly therefrom and arranged to be positioned in front of said shelf front portion when said lugs are received in shelf openings, (d) said central body portion having top and bottom edges and opposite side edges, (e) spring clip means integral with and extending rearwardly from said bottom edge of said central body portion and adapted for resilient frictional engagement with a shelf bottom surface, and (f) label supporting clip means extending forwardly from said, (g) said bracket being formed of a unitary stamping of spring steel sheet material.

2. A snap-on mounting bracket according to claim 1, wherein (a) said label supporting clip means comprises an element extending forward and upward from said central body portion and engageable with a label housing to support said label housing at the front of the shelf.

3. A snap-on mounting bracket according to claim 1, wherein said label supporting clip means comprises (a) upper label-engaging clip means integral with and extending forward and downward from the top edge of said central body portion, and (b) lower label-engaging clip means integral with and extending forward and upward from the bottom edge of said central body portion.

4. A snap-on mounting bracket according to claim 3, wherein (a) said upper support member and said spring clip means extend from said central body portion in a direction opposite to said upper and lower label-engaging clip means, whereby (b) squeezing pressure between said upper support member and said spring clip tends to open said label-engaging clip means to accommodate the installation and removal of a label from said mounting bracket.

5. A snap-on mounting bracket according to claim 1, wherein (a) said upper support member and said central body portion are disposed at an angle greater than 90 degrees, (b) said upper support member and said central body portion being resiliently joined along said top edge to enable the angle between said central body portion and said upper support member to adjust in accordance with the configuration of the shelf front portion.

6. A snap-on mounting bracket according to claim 1, wherein (a) said spring clip means comprises a first arcuately contoured portion joined with the bottom edge of said central body portion and extending generally rearward, and (b) a guide tab is joined integrally with said arcuately contoured portion and extends rearward and downward therefrom.

* * * * *